US008720020B2

(12) United States Patent
Biancalani et al.

(10) Patent No.: US 8,720,020 B2
(45) Date of Patent: May 13, 2014

(54) MACHINE AND METHOD FOR THE COMBINED MECHANICAL AND HEAT TREATMENT OF FABRICS, ESPECIALLY KNITTED FABRICS

(75) Inventors: Massimo Biancalani, Prato (IT); Riccardo Ravagli, Pistoia (IT)

(73) Assignee: Biancalani S.R.L., Prato (IT)

( * ) Notice: Subject to any disclaimer, the term of this patent is extended or adjusted under 35 U.S.C. 154(b) by 215 days.

(21) Appl. No.: 13/132,452

(22) PCT Filed: Dec. 3, 2009

(86) PCT No.: PCT/IB2009/007642
§ 371 (c)(1),
(2), (4) Date: Jun. 2, 2011

(87) PCT Pub. No.: WO2010/064130
PCT Pub. Date: Jun. 10, 2010

(65) Prior Publication Data

US 2011/0232053 A1 Sep. 29, 2011

(30) Foreign Application Priority Data

Dec. 3, 2008 (IT) ..... PO2008A0018

(51) Int. Cl.
*D06C 7/00* (2006.01)
*D06C 19/00* (2006.01)
*F26B 13/00* (2006.01)

(52) U.S. Cl.
USPC ..... 28/165; 26/18.5; 26/20

(58) Field of Classification Search
USPC ..... 26/18.5, 20, 21, 22, 23, 18.6, 1, 19, 25, 26/26, 51; 28/165, 100, 155, 167, 142; 34/401, 381, 203, 380, 60, 623, 164
See application file for complete search history.

(56) References Cited

U.S. PATENT DOCUMENTS

| | | | | | |
|---|---|---|---|---|---|
| 3,005,250 | A | * | 10/1961 | Hatay | 26/18.5 |
| 3,077,655 | A | * | 2/1963 | Runton | 26/18.5 |
| 3,594,914 | A | | 7/1971 | Kutsuki et al. | |
| 3,797,126 | A | * | 3/1974 | Parkes | 34/114 |
| 4,055,003 | A | * | 10/1977 | Sack | 34/632 |
| 4,219,942 | A | | 9/1980 | Coliva | |
| 4,345,385 | A | * | 8/1982 | Sando et al. | 34/446 |
| 4,773,133 | A | * | 9/1988 | Voisin et al. | 26/18.5 |
| 4,965,918 | A | * | 10/1990 | Magin | 26/18.5 |

FOREIGN PATENT DOCUMENTS

| | | | |
|---|---|---|---|
| EP | 0130342 | A2 | 1/1985 |
| EP | 0148113 | A1 | 7/1985 |
| EP | 0 666 354 | A | 8/1995 |
| FR | 1024514 | | 4/1953 |
| GB | 879483 | | 10/1961 |
| GB | 1178270 | | 1/1970 |
| GB | 1304733 | | 1/1973 |
| GB | 2103670 | | 2/1983 |

OTHER PUBLICATIONS

English language machine translation of EP 148113, publication date Jul. 10, 1985, translation document 7 pages.*

* cited by examiner

*Primary Examiner* — Amy Vanatta
(74) *Attorney, Agent, or Firm* — McGlew and Tuttle, P.C.

(57) ABSTRACT

A machine and a method for treating fabrics, comprise in combination a step of inducing substantially vertical vibrations in a quantity of fabric in the form of a substantially compact mass and a simultaneous step of drying the rest of the fabric in opened-out form.

20 Claims, 3 Drawing Sheets

MACHINE AND METHOD FOR THE COMBINED MECHANICAL AND HEAT TREATMENT OF FABRICS, ESPECIALLY KNITTED FABRICS

TECHNICAL FIELD

This invention relates to a machine and method for the combined mechanical and thermal treatment of fabrics to provide effects of dimensional restorability and hand and, in particular, for treating knitted fabrics continuously or discontinuously.

PRIOR ART

As is well known in the textile industry, it is a strong requirement that a fabric maintains its dimensional stability even after tailoring, wearing and ordinary cleaning and laundering treatments. This applies in particular to knitted fabrics which, by their very nature, tend to lose their dimensional stability more easily than other fabrics. For this purpose, fabric finishing processes use various devices and treatments to promote the dimensional restorability of the fabric so that this value is as close as possible to the maximum that this will have during the future washing and drying treatments necessary for cleaning an item of clothing tailored with the fabric. Of the treatments currently possible, those most commonly used are essentially the following:

- run through a free dryer where the open-width, wet or moistened fabric is overfed continuously on a conveyor belt moving through a drying tunnel;
- run through a compactor where the open-width, moistened and heated fabric is continuously forced mechanically to recover its length;
- drying in a tumbler where the fabric in rope form is discontinuously loaded into a rotating tumbler and heated with hot air.

The first and second types of treatment are not particularly effective and, in most cases, both the treatments, performed immediately after one another, are necessary to obtain an acceptable result.

The third type of prior art treatment, that is, tumble drying, is by far the most effective and is normally used as a limit term of reference.

Tumble drying, however, has the serious disadvantages of being discontinuous, with the fabric in rope form, of being possible only on small quantities at a time with problems of knotting and wringing, of not providing uniform quality and, lastly, of being labour-intensive.

The treatments described above, when applied to knitted fabrics in particular, make it very difficult to eliminate the stresses generated in the fibres in the course of knitting, which means that obtaining a dimensionally recovered and well stabilized fabric can be a problem.

The methods used to help fabric relaxation include vibrating or beating in order to reduce friction between the fibres and between the fibres and other surfaces in contact with them.

Patent documents GB1178270, GB 1304733, EP148113A1, EP130342A2, U.S. Pat. No. 4,219,942 describe machines equipped with vibrating conveyor belts for the fabric. The flexibility of the belts in these machines prevents vibrations from being adequately transmitted to the fabric.

Patent document GB2103670 describes apparatus and methods for relieving stresses in fabric which is made up into a roll or bolt preparatory to further processing. In one of the examples described, the fabric is unwound in such a way as leave a portion of it slack and to lay it on a vibrating plate.

Document GB879483 describes an apparatus in which a damp fabric is made to vibrate using a vibrating grid in a drying zone. The amplitude of vibration imparted to the fabric decreases progressively in the direction of fabric feed.

Document FR1024514 describes a method for stress-relieving a fabric where the fabric is opened out and made to pass on a vibrating support. Alternatively, the fabric may be folded on a vibrating table. To increase the efficacy of the treatment, the fabric may be loaded with weights.

Document U.S. Pat. No. 3,594,914 describes an apparatus comprising at least an inclined vibrating plate on which the fabric slides and is exposed to heating jets.

The solutions cited above are not entirely satisfactory because the vibrations are imparted to fabric surfaces that are in an opened-out form or are moderately pleated.

Although this determines a reduction in the friction between the fibres, the accelerations transmitted to them are limited.

In other words, the forces of inertia generated and acting on the fibres are insufficient to dimensionally recover and stabilize the fabric to a good degree.

DISCLOSURE OF THE INVENTION

This invention therefore has for an aim to provide a process for treating fabrics continuously and discontinuously in open-width form, and which permits drying of a fabric, especially a knitted fabric, while simultaneously obtaining an effect of recovery, swelling and relaxation that improves hand feel and dimensional stability.

To achieve this aim, the invention provides a machine and method according to the appended claims, where the fabric is treated by the special combined action of heat and mechanical vibration.

The advantages lie essentially in the fact that the treated fabric does not exhibit residual tension due to elastic or plastic deformation which is recovered by the combination treatment and thus does not lead to dimensional instability in the fabric during subsequent processes.

These and other advantages will be better understood from the following description with reference to the accompanying drawings illustrating preferred non-limiting embodiments of the invention.

PREFERRED EMBODIMENT OF THE INVENTION

Figure 1:
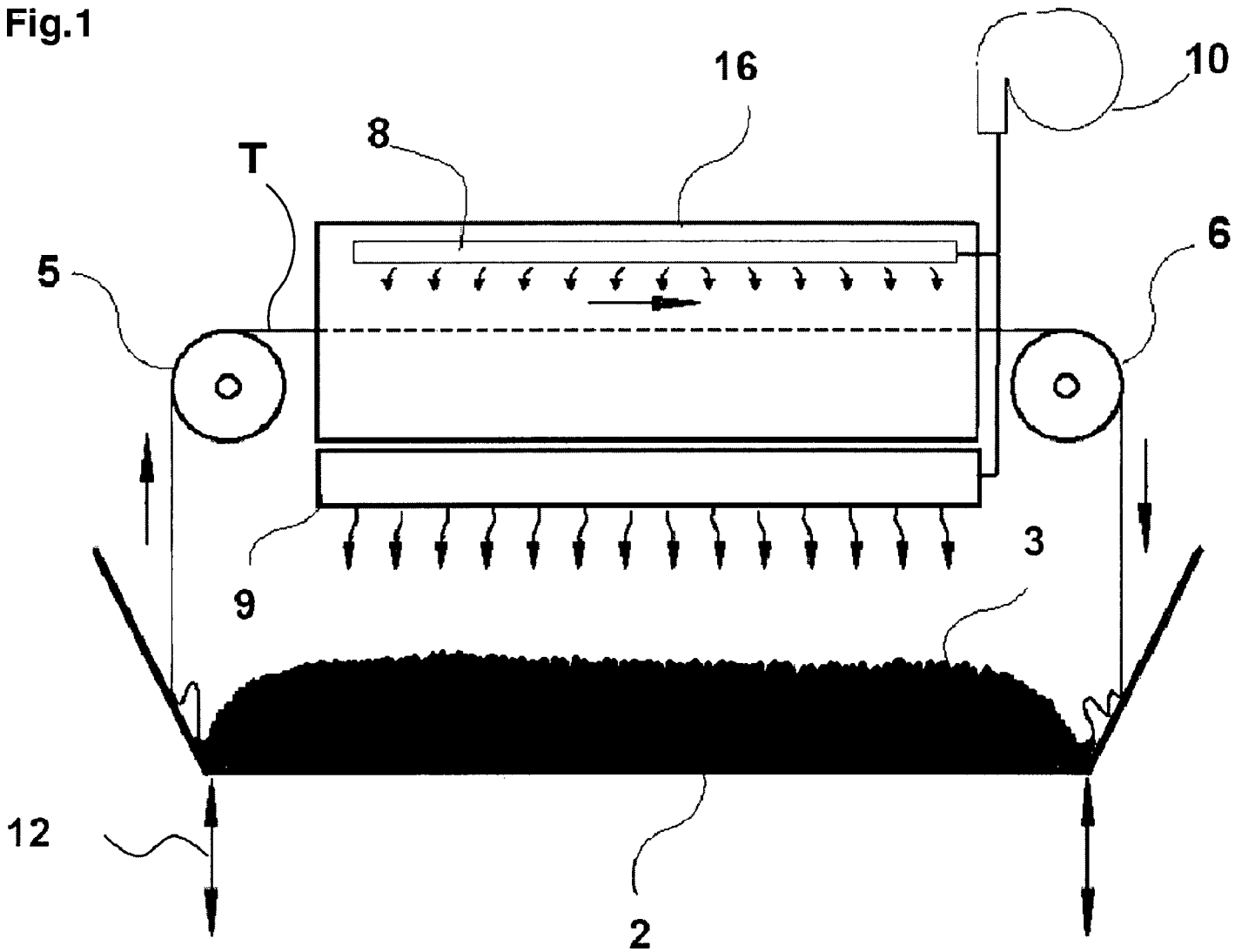
FIG. 1 schematically illustrates a machine according to the invention for the discontinuous treatment of a fabric.

FIG. 1 illustrates a first embodiment of a machine according to the invention for the discontinuous, combined mechanical and thermal treatment of a fabric T. To better illustrate the essential parts of the machine, the containment walls are not shown. The machine comprises a rigid, vibrating platform 2, preferably in the form of a tub, and a drying tunnel 16 equipped with a hot air distributor 8 fed by a fan 10. Power-driven rollers 5, 6 are provided for picking up the fabric T from the platform, running it through the tunnel and returning it to the platform.

According to the invention, the fabric T passing over the vibrating platform 2 is, instant by instant, in the form of a substantially compact mass 3, with the exception of the portion of it that is picked up from the platform, opened out and run through the drying tunnel and then placed on the platform again.

The platform 2 is mounted on visco-elastic suspension elements 12 and is made to vibrate by a slider-crank mechanism of per se known type.

In the embodiment illustrated, the platform 2 has a flat surface for supporting the fabric but other shapes—for example, curved or polygonal—are also imaginable.

The vibrations or oscillations are preferably vertical or have a significant vertical component.

In particular, the amplitude and frequency of the oscillations are induced in such a way that the acceleration impressed on the fabric is greater than gravity, so that the entire mass of the fabric is jolted and not just the part of it that is in direct contact with the platform 2, as in the case of prior art vibrating belt known systems.

For example, the peak-to-peak amplitude of the vibrations or oscillations may be between 20 and 60 mm, and the frequency between 5 and 15 Hz or, more preferably, between 5 Hz and 10 Hz.

The heating system 8 is preferably of the hot air type, with air partly recirculated, if necessary.

To increase the effectiveness of the treatment the fabric T should initially be in a moistened or wet state.

Heating means 9 may be provided for acting on the mass 3 of fabric subjected to the vibratory action.

Figure 2:
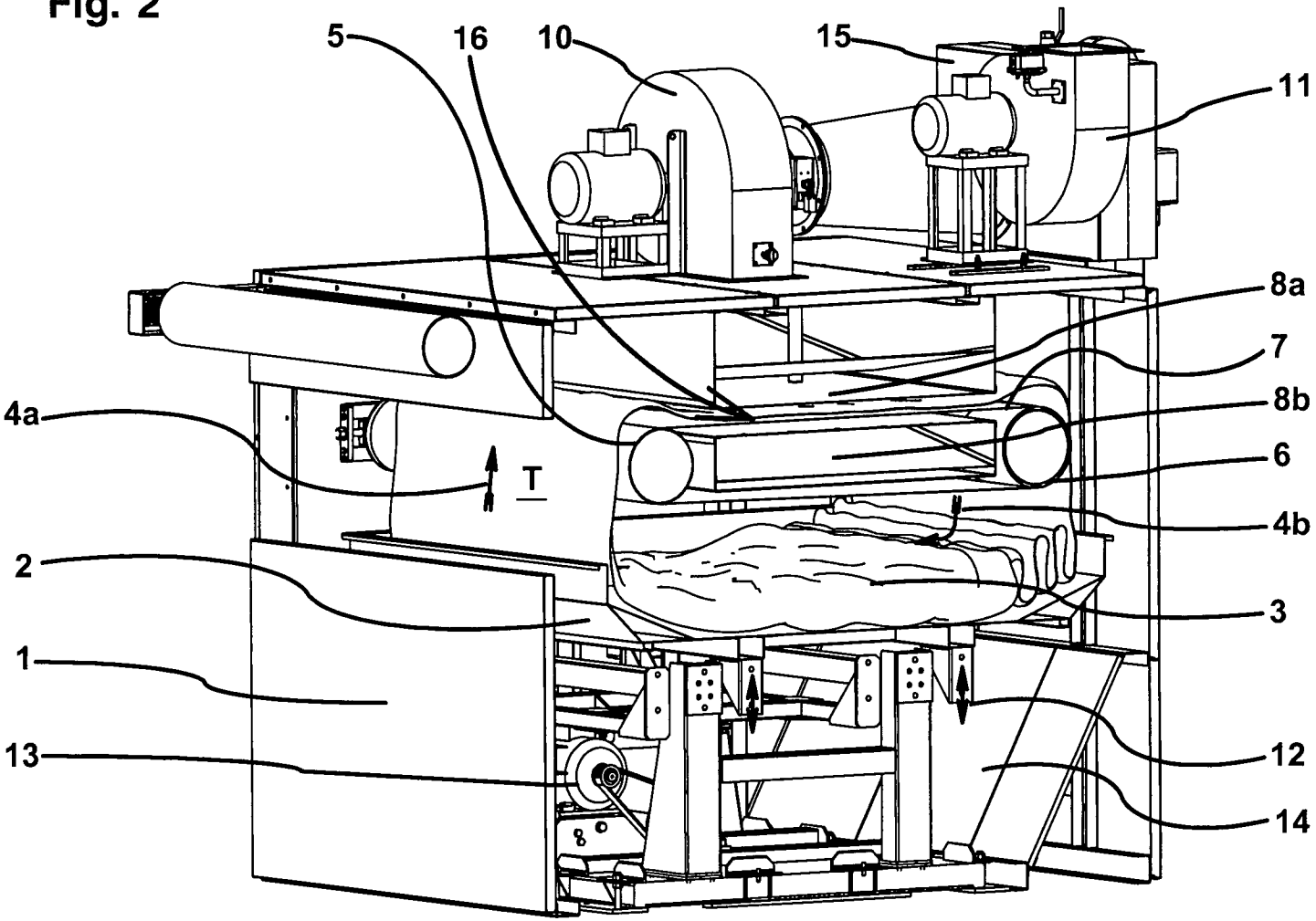
FIG. 2 is a schematic perspective view of a preferred embodiment of the machine of FIG. 1.

FIG. 2 shows a preferred embodiment of a machine according to the invention for the discontinuous treatment of a knitted fabric.

A substantially compact mass 3 of fabric T to be treated is placed on a vibrating platform 2. A heated tunnel, comprising a pair of hot air distributors, namely an upper distributor 8*a* and a lower distributor 8*b*, is mounted over the vibrating platform.

A mechanical suspension and vibration system 12 powered by an electric motor 13, elastically supports, and imparts vertical oscillations to, the platform 2.

The fabric is sewn head to tail in such a way as to form a closed loop that moves round continuously within the machine.

In effect, it is picked up from the platform by the roller 5 (see arrow 4*a*) and returned to the platform by the roller 6 (see arrow 4*b*) after being placed on the conveyor belt 7 and passed through the drying tunnel formed by the distributors 8*a* and 8*b*.

The hot air fed into the tunnel by the distributors 8*a* and 8*b* through the fan 10 and heated by a direct or indirect heating system 15 may be partly recirculated and partly renovated depending on the flow rate set using the extraction fan 11.

A filter 14 intercepts all the air moved by the recirculation fan 10 and by the extraction fan 11, thus preventing airborne fluff from building up in the machine and/or escape through the extraction duct.

Figure 3:
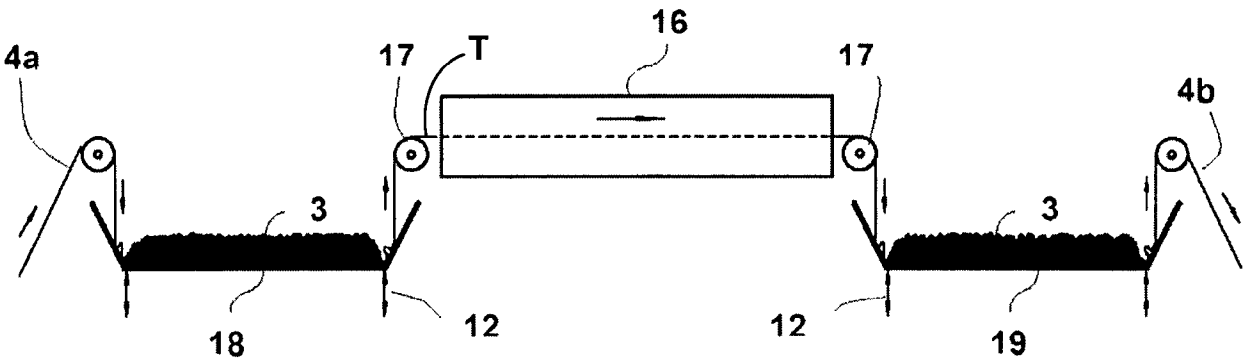
FIG. 3 schematically illustrates a machine according to the invention for the continuous treatment of a fabric.
Figure 4:
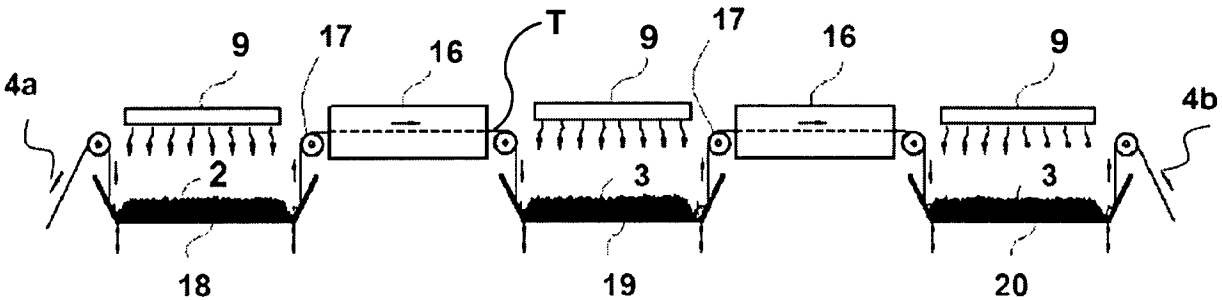
FIG. 4 schematically illustrates another embodiment of the machine according to the invention for the continuous treatment of a fabric.

FIGS. 3 and 4 illustrate embodiments of the machine for the continuous treatment of a fabric T in open-width form.

In FIG. 3 the fabric in the form of a substantially compact mass is fed continuously onto a first vibrating platform 18 and from there is transferred by rollers 17 through a heated tunnel 16 to a second vibrating platform 19 from where it is fed continuously out of the machine.

Advantageously, this embodiment makes it possible to apply an alternating movement to the fabric between the two platforms at suitably higher speeds than the speeds at which it is fed into and out of the machine, so as to keep a constant load of fabric in the machine but increasing by a desired amount the length of time it remains in the machine.

FIG. 4 shows three consecutive vibrating platforms 18, 19, 20 alternated with two drying tunnels 16, as an example of a modular installation using any number of vibrating platforms and heated tunnels 16 to perform continuous treatment in open-width form at proportionally higher production speeds.

As illustrated in the drawing, each vibrating platform may be equipped with a heating element 9 mounted over it. Further, the fabric feeding in may be conveniently pre-heated and that feed out thermoset by suitable additional heating systems, whether of the hot air type, like the tunnel 16, or of other type.

The invention achieves considerable technical advantages.

A first advantage is that the fabric can be placed in whole or in part on one or more rigid, vibrating platforms, in such a way that the relaxation and compacting action induced in the mass of fabric accumulated on the platform can, in combination with the action of the heat applied by the drying system, absorb residual tensions in the fabric and recover deformation, whether elastic or plastic.

This advantage is particularly significant if we consider that fabric stretch is usually more plastic then elastic.

It is also possible to apply to the platforms vibrations whose frequency and amplitude are such as not to simply reduce the friction between the platform and the fabric, and hence the tension created by this, but also to induce in the fabric accelerations that are multiples of gravity acceleration and hence mass forces that are multiples of the fabric's weight in such a way as to make the fibres slide relative to each other and to obtain a considerable compacting and stabilizing effect.

The invention claimed is:

1. A machine for treating fabrics, comprising:

at least one rigid vibrating platform, said at least one rigid vibrating platform inducing substantially vertical vibrations in a first length of fabric in the form of a substantially compact mass supported by the at least one rigid vibrating platform;

a drying means for drying a second length of the fabric; and a conveying means for picking up the fabric from said at least one rigid vibrating platform, spreading out the second length of the fabric and depositing the fabric on one of said at least one rigid vibrating platform and another rigid vibrating platform, wherein the second length of the fabric is in a spread out state as the second length of fabric is dried via said drying means.

2. A machine according to claim 1, further comprising:

a means, cooperating with said at least one rigid vibrating platform, for inducing vibrations whose frequency and amplitude are such as to impart to the first length of the fabric accelerations that are greater than gravity acceleration.

3. A machine according to claim 1, further comprising:

a means, cooperating with said at least one rigid vibrating platform, for inducing vibrations whose peak-to-peak amplitude is between 20 and 60 mm, and whose frequency is between 5 Hz and 15 Hz.

4. A machine according to claim 1, wherein said platform is in the form of a tub for containing the first length of the fabric, said tub having walls for guiding the fabric when the fabric is picked up and deposited via said conveying means.

5. A machine according to claim 1, wherein the drying means comprises at least one drying tunnel associated with the at least one rigid vibrating platform in such a way as to allow the fabric to be treated to pass continuously or alternatingly from the at least one rigid vibrating platform to the at least one drying tunnel and vice versa, in order to treat fabrics continuously or discontinuously.

6. A machine according to claim 1, wherein said drying means comprises at least one drying tunnel, said another rigid vibrating platform and said at least one rigid vibrating platform being operatively associated with, and positioned relative to, said at least one drying tunnel in such a way as to allow the fabric to be treated to pass continuously or alternatingly from said at least one platform, through the at least one drying tunnel to said another platform.

7. A machine according to claim 1, further comprising:

a means, cooperating with said at least one rigid platform, for inducing vibrations whose peak-to-peak amplitude is between 20 and 60 mm, and whose frequency is between 5 Hz and 10 Hz.

8. A machine according to claim 2, further comprising:

a means for inducing vibrations whose peak-to-peak amplitude is between 20 and 60 mm, and whose frequency is between 5 Hz and 15 Hz.

9. A machine according to claim 2, further comprising:

a means for inducing vibrations whose peak-to-peak amplitude is between 20 and 60 mm, and whose frequency is between 5 Hz and 10 Hz.

10. A machine according to claim 1, wherein said drying means defines a drying fabric area, said conveying means comprising a first roller, a second roller and a conveyor belt, said first roller being located adjacent to one end of said drying fabric area, said second roller being located adjacent to another end of said drying fabric area, at least a portion of said conveyor belt being arranged in said drying fabric area, wherein another portion of said conveyor belt is located at a position outside of said drying fabric area, said at least one rigid vibrating platform comprising a tub, said tub having walls for guiding the fabric when the fabric is picked up and deposited via said conveying means.

11. A machine according to claim 10, further comprising:

a heating means for heating the first length of the fabric, said heating means being located at a position below said drying means.

12. A machine according to claim 10, further comprising:

a heating means for heating the first length of the fabric, said heating means being located opposite said drying means and said at least one rigid vibrating platform.

13. A method for treating fabrics, comprising:

providing at least one rigid platform;

inducing substantially vertical vibrations in a first length of fabric and simultaneously drying a second length of the fabric, wherein said vertical vibrations are directly induced by said at least one rigid platform in a substantially compact mass of said first length of the fabric;

providing a conveying means;

picking up the fabric from said at least one rigid platform with said conveying means and spreading out the second length of the fabric to form a spread out state of the second length of the fabric via said conveying means, wherein said second length of the fabric is dried with said second length of the fabric in said spread out state;

depositing the fabric on one of said at least one rigid platform and another rigid platform via said conveying means after drying of the fabric.

14. A method according to claim 13, wherein the frequency and amplitude of the vibrations are such as to impart to the first length of the fabric accelerations that are greater than gravity acceleration.

15. A method according to claim 13, wherein said drying means defines a drying fabric area, said conveying means comprising a first roller, a second roller and a conveyor belt, said first roller being located adjacent to one end of said drying fabric area, said second roller being located adjacent to another end of said drying fabric area, at least a portion of said conveyor belt being arranged in said drying fabric area, wherein another portion of said conveyor belt is located at a position outside of said drying fabric area, said at least one rigid vibrating platform comprising a tub, said tub having walls for guiding the fabric when the fabric is picked up and deposited via said conveying means.

16. A method according to claim 15, further comprising:

providing a heating means, said heating means being located at a position below the second length of the fabric and said heating means being located at a position above the first length of the fabric;

heating the first length of the fabric with said heating means.

17. A method according to claim 15, further comprising:

providing a heating means, said heating means being located opposite said drying means and said at least one rigid platform;

heating the first length of the fabric with said heating means.

18. A machine for treating fabrics, comprising:

a vibrating platform for supporting a first length of fabric, said vibrating platform imparting substantially vertical vibrations in the first length of the fabric;

a heating means providing heat to a drying fabric area for drying a second length of the fabric; and a conveying means for transporting the fabric from said vibrating platform through said drying fabric area to one of said vibrating platform and another vibrating platform and for spreading out the second length of the fabric to form a flat, spread out state of the second length of the fabric such that the second length of fabric is in said flat, spread out state as the second length of the fabric passes through said drying fabric area.

19. A machine according to claim 18, further comprising:

another heating means for heating the first length of the fabric, said another heating means being located at a position below said heating means, said vibrating platform comprising a tub, said conveying means comprising a first roller, a second roller and a conveyor belt, said first roller being located adjacent to one end of said drying fabric area, said second roller being located adjacent to another end of said drying fabric area, at least a portion of said conveyor belt being arranged in said drying fabric area, wherein another portion of said conveyor belt is located at a position outside of said drying fabric area, said at least one rigid vibrating platform comprising a tub, said tub having walls for guiding the fabric when the fabric is picked up and deposited via said conveying means.

20. A machine according to claim 18, further comprising:

another heating means for heating the first length of the fabric, said another heating means being located opposite said drying means and said at least one rigid vibrating platform, said conveying means comprising a first roller, a second roller and a conveyor belt, said first roller being located adjacent to one end of said drying fabric area, said second roller being located adjacent to another end of said drying fabric area, at least a portion of said conveyor belt being arranged in said drying fabric area, wherein another portion of said conveyor belt is located at a position outside of said drying fabric area, said at least one rigid vibrating platform comprising a tub, said tub having walls for guiding the fabric when the fabric is picked up and deposited via said conveying means.

* * * * *